US008002258B2

(12) United States Patent
Nakagawa et al.

(10) Patent No.: US 8,002,258 B2
(45) Date of Patent: Aug. 23, 2011

(54) TAB SHEET INSERTION APPARATUS

(75) Inventors: Michihiro Nakagawa, Sagamihara (JP); Tamotsu Sakuraba, Sagamihara (JP); Toshimi Shinchi, Saitama (JP); Yukihiko Ichikawa, Tokyo (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 12/572,499

(22) Filed: Oct. 2, 2009

(65) Prior Publication Data

US 2010/0019436 A1 Jan. 28, 2010

Related U.S. Application Data

(62) Division of application No. 11/771,041, filed on Jun. 29, 2007, now abandoned.

(30) Foreign Application Priority Data

Feb. 21, 2007 (JP) ..... 2007-040742

(51) Int. Cl.
*B65H 33/04* (2006.01)

(52) U.S. Cl. ..... 270/58.32; 270/52.04; 270/58.31

(58) Field of Classification Search ..... 270/52.04, 270/52.05, 58.31, 58.32
See application file for complete search history.

(56) References Cited

U.S. PATENT DOCUMENTS

| | | | | |
|---|---|---|---|---|
| 5,012,073 | A | 4/1991 | Hewitt et al. | |
| 2003/0070146 | A1* | 4/2003 | Sato et al. | 715/525 |
| 2005/0158093 | A1* | 7/2005 | Kato et al. | 399/388 |
| 2008/0175636 | A1 | 7/2008 | Sakuraba et al. | |
| 2008/0197556 | A1 | 8/2008 | Nakagawa et al. | |
| 2008/0260412 | A1 | 10/2008 | Shinchi et al. | |

FOREIGN PATENT DOCUMENTS

| | | | |
|---|---|---|---|
| JP | 11-042872 | A | 2/1999 |
| JP | 2001-103823 | A | 1/2001 |
| JP | 2005-071162 | A | 3/2005 |
| JP | 2005-89112 | A | 4/2005 |
| JP | 2005-182757 | A | 7/2005 |
| JP | 2005-271259 | A | 10/2005 |
| JP | 2006-248672 | | 9/2006 |

OTHER PUBLICATIONS

Notification of Reason(s) for Refusal issued in corresponding Japanese Application No. 2007-040742 dated Oct. 27, 2009, and an English Translation thereof.
Notification of Reason for Refusal in JP 2007-040742, dated Mar. 10, 2009, and an English Translation thereof.

* cited by examiner

*Primary Examiner* — Leslie A Nicholson, III
(74) *Attorney, Agent, or Firm* — Buchanan Ingersoll & Rooney PC

(57) ABSTRACT

An image forming apparatus has a tab sheet supply unit and a control unit. The tab sheet supply unit supplies tab sheets of an identical type from an identical sheet supply tray as a chapter tab sheet to be inserted at a breakpoint of a first level of classification of a document to be printed, as well as a section tab sheet to be inserted at a breakpoint of a second level that is a finer level of classification than the first level of classification. The control unit causes the tab sheet contained in the sheet supply tray to be discharged as an unnecessary tab sheet, if the tab position of the tab sheet to be supplied next from the sheet supply tray does not match with the tab position of the tab sheet to be inserted next during the printing of the document, until both of the tab positions match.

7 Claims, 15 Drawing Sheets

TAB SHEET INSERTION APPARATUS

CROSS-REFERENCE TO RELATED APPLICATION

This application is based on Japanese Patent Application No. 2007-040742 filed on Feb. 21, 2007, the contents of which are incorporated herein by reference.

BACKGROUND

1. Technical Field

The present invention relates to a tab sheet insertion apparatus, an image forming apparatus having tab sheet inserting function, a method executed on the image forming apparatus, and a computer readable recording medium stored with a control program for controlling the image forming apparatus.

2. Description of the Related Art

There exist printing apparatuses such as copying machines and printers that are capable of creating printed products by inserting between pages a tab sheet having a flat rectangular main body and a tab protruding at a specified position on a side of said may body. See Unexamined Publication No. 2005-182757. In such a printing apparatus, it is customary that multiple sets of tab sheets consisting of five tab sheets, whose tab positions are sequentially offset from each other, are used as constituents and are placed in a sheet supply tray.

Incidentally, if a printed matter consists of "chapters" and "sections," it is desirable from the viewpoint of easy and quick browsing of the printed matter to be able to differentiate the tab sheet to be used at the breakpoints of "chapters" from the tab sheet to be used at the breakpoints of "sections."

However, in the printing apparatus disclosed in the above-mentioned patent document, the tab sheets of the same type are supplied from the same sheet supply tray. In other words, tab sheets as constituents with sequentially offset tab positions are supplied and inserted into the printed matter in the sequential order of their stacking in the sheet supply tray. As a result, there was a problem that it is impossible to use tab sheets by dividing them into tab sheets for major divisions and tab sheets for minor divisions, such as tab sheets used at breakpoints of "chapters" and tab sheets used at breakpoints of "sections."

SUMMARY

To solve at least one of the above mentioned problems, an image forming apparatus reflecting one aspect of the present invention comprises a tab sheet supply unit that supplies tab sheets of an identical type from an identical sheet supply tray as a major division tab sheet to be inserted at a breakpoint of a first level of classification of a document to be printed, as well as a minor division tab sheet to be inserted at a breakpoint of a second level that is a finer level of classification than the first level of classification; and a control unit that causes the tab sheet contained in said sheet supply tray to be discharged as an unnecessary tab sheet, if the tab position of the tab sheet to be supplied next from the sheet supply tray does not match with the tab position of the tab sheet to be inserted next during the printing of said document, until both of the tab positions match.

The objects, features, and characteristics of this invention other than those set forth above will become apparent from the description given herein below with reference to preferred embodiments illustrated in the accompanying drawings.

DETAILED DESCRIPTION

The embodiment of this invention will be described below with reference to the accompanying drawings.

Figure 1:
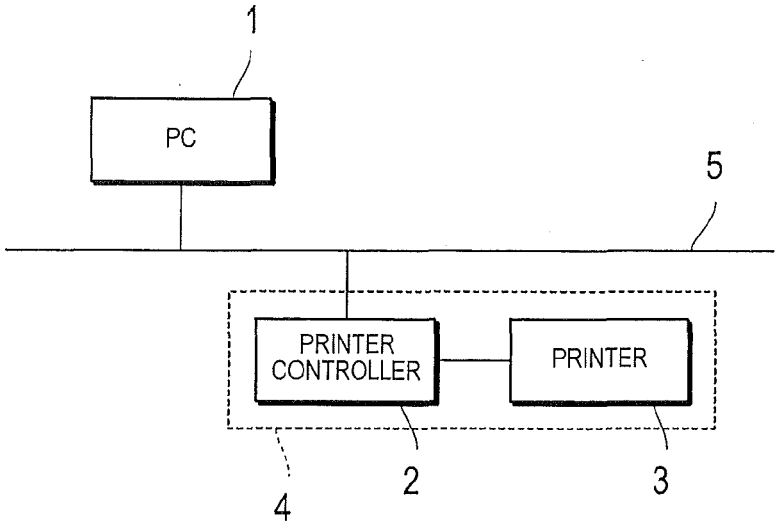
FIG. 1 is a block diagram showing the overall constitution of a network system according to a first embodiment of the present invention.

FIG. 1 is a block diagram showing the overall constitution of a network system according to a first embodiment of the present invention.

The network system that relates to this embodiment is equipped with a PC 1 as a printing instruction device for instructing the printing of the document and a printing system 4 for conducting printing based on printing instructions of the PC 1, which are connected with each other via a network 5. Also, the PC 1 and the printing system 4 can be connected directly (local connection) without recourse to the network 5.

The printing system 4 consists of a printer controller 2 and a printer 3 as an image forming apparatus and also as a tab sheet insertion apparatus, which are locally connected with each other. This local connection can be accomplished by means of various local connection interfaces, such as serial interfaces, e.g., USB and IEEE 1394, parallel interfaces, e.g., SCSI and IEEE 1284, wireless communication interfaces, e.g., Bluetooth®, IEEE 802.11, HomeRF®, IrDA®, etc.

However, the printer controller 2 and the printer 3 can be connected via the network 5.

Figure 2:
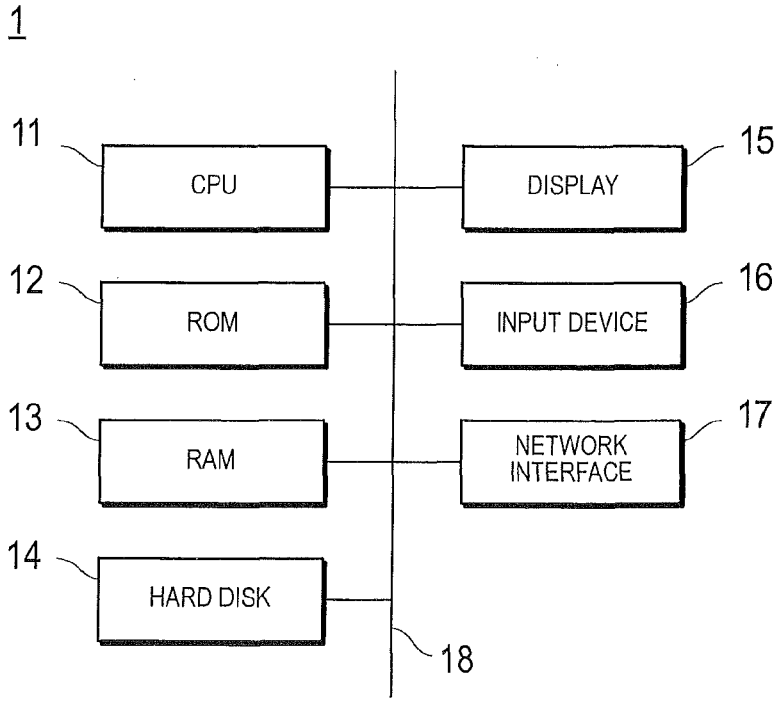
FIG. 2 is a block diagram showing the constitution of the PC shown in FIG. 1.

FIG. 2 is a block diagram showing the constitution of PC 1 shown in FIG. 1.

The PC 1 contains a CPU 11, a ROM 12, a RAM 13, a hard disk 14, a display 15, an input device 16 and a network interface 17, all of which are interconnected via a bus 18 for exchanging signals.

The CPU 11 controls various parts indicated above and executes various arithmetic processes according to a program. The ROM 12 stores various programs and data. The RAM 13 stores programs and data temporarily as a working area. The hard disk 14 stores various programs including an operating system and data.

An application program for generating document files and a printer driver for converting the document files into PDL data described in a Page Description Language ("PDL") understood by the printing system 4 are installed on the hard disk 14. The printer driver is capable of providing instructions for printing document files prepared with the use of applications, setting up printing output conditions, and setting up tab sheet related matters. The printer drive contains programs for executing these settings.

The display 15 can be LCD, CRT, and other displays, on which various kinds of information are displayed. The input device 16 includes a pointing device such as a mouse, a keyboard, and others, and is used for executing various kinds of information inputs.

The network interface 17 is an interface for communicating with other devices on the network via the network 5 using standards such as Ethernet®, Token Ring, FDDI, etc.

Figure 3:
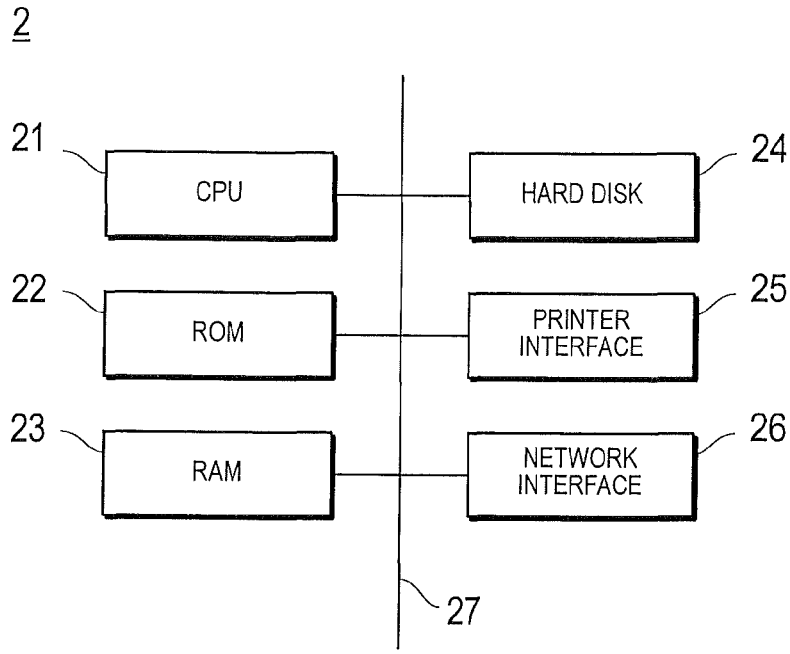
FIG. 3 is a block diagram showing the constitution of the printer controller of the printing system shown in FIG. 1.

FIG. 3 is a block diagram showing the constitution of the printer controller 2 of the printer system 4 shown in FIG. 1.

The printer controller 2 is provided with a CPU 21, a ROM 22, a RAM 23, a hard disk 24, a printer interface 25, and a network interface 26, all of which are interconnected with each other via a bus 27 for exchanging signals. The descriptions of those parts of the printer controller 2 that have the same functions as those of the corresponding parts of the PC 1 will be omitted here to avoid being duplicative.

The ROM 22 and hard disk 24 stores a rasterizing process program for translating PDL data received from PC1 and developing it into bitmap data, which is bitmap type image data, as well as an image data process program for analyzing the received PDL data. The received PDL data and the bitmap data can be saved on the hard disk 24.

The printer interface 25 is an interface for communicating with the locally connected printer 3.

Figure 4:
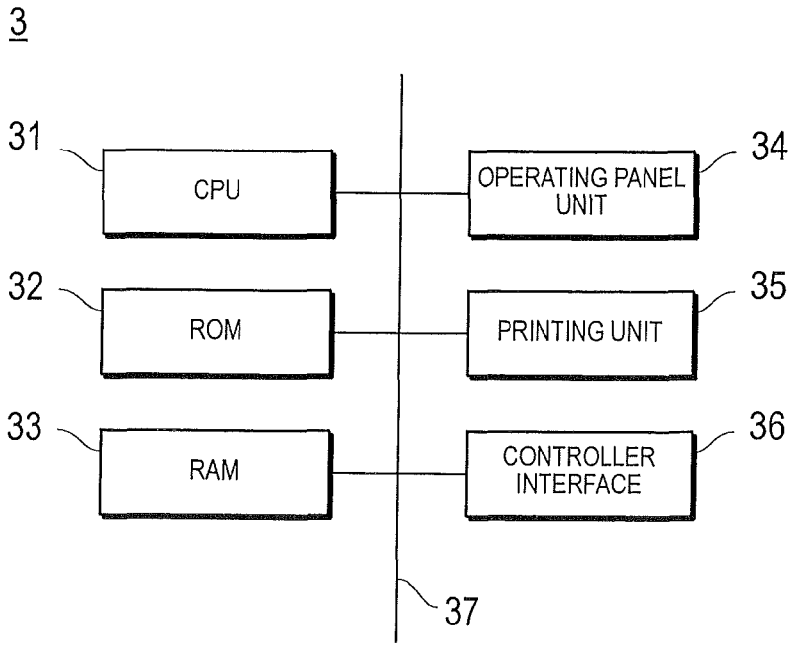
FIG. 4 is a block diagram showing the constitution of the printer of the printing system shown in FIG. 1.

FIG. 4 is a block diagram showing the constitution of the printer 3 of the printing system 4 shown in FIG. 1. The printer 3 has a CPU 31, a ROM 32, a RAM 33, an operating panel 34, a printing unit 35, and a controller interface 36, all of which are interconnected with each other via a bus 37 for exchanging signals. The descriptions of those parts of the printer 3 that have the same functions as those of the corresponding parts of the PC 1 will be omitted here to avoid being duplicative.

The ROM 32 stores a printing process program to be executed based on printing data containing bitmap data received from the printer controller 2.

The operating panel unit 34 is equipped with a touch panel, a ten-key pad, a start button, a stop button and others to be used for displaying various data and entering various instructions.

The printing unit 35 prints images based on bitmap data received from the printer controller 2 using a publicly known imaging process such as the electronic photography process on recording media such as paper. The controller interface 36 is an interface for communicating with the locally connected printer controller 2.

Figure 5:
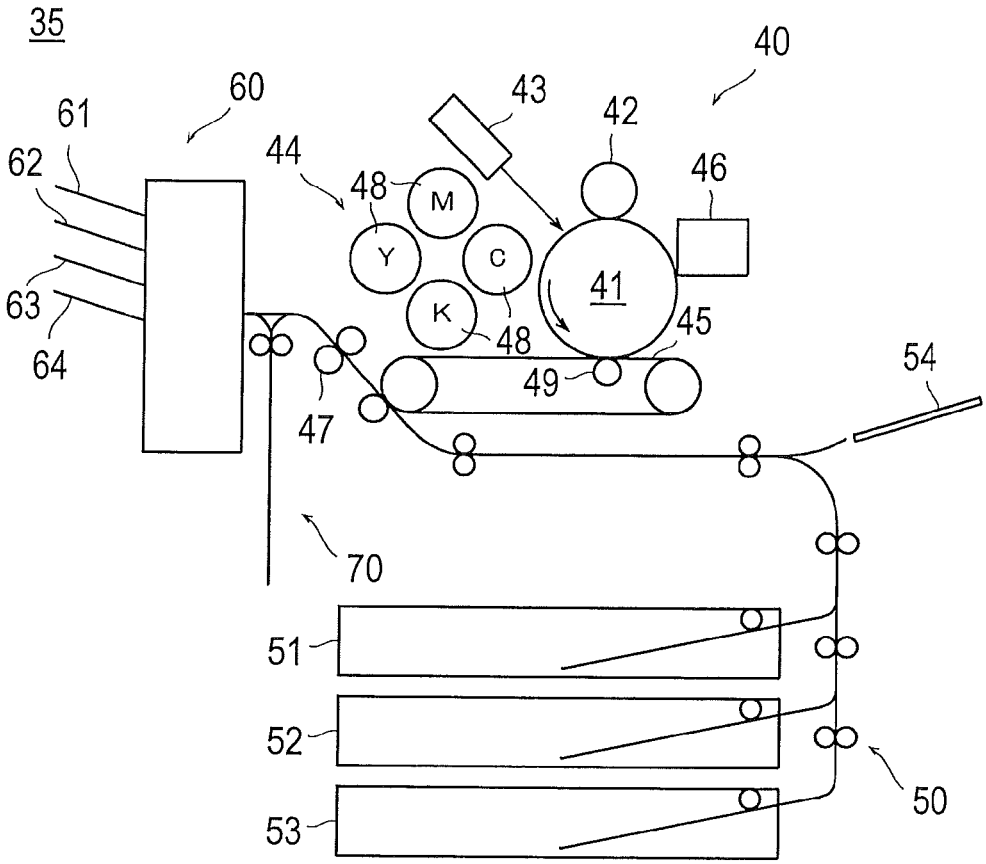
FIG. 5 is a diagram showing the typical constitution of a printing unit.

FIG. 5 is a diagram showing the typical constitution of a printing unit 35.

The printing unit 35 has a paper supply unit 50 for supplying recording media such as printing paper and insertion sheets such as tab sheets, an image forming unit 40 for forming images on the recording media, and a paper discharge unit 60 for discharging printing paper and tab sheets. The printing unit 35 also has a reversing mechanism unit 70 for reversing the front and back sides of printing paper.

The image forming unit 40 of the printing unit 35 has a sensitizer drum 41 that rotates in the arrow direction, a charging device 42, exposing device 43, a developing device 44, an intermediate transfer belt 45, a cleaning device 46, and a fixing device 47. After the surface of the sensitizer drum 41 is evenly charged by means of the charging device 42, an electrostatic latent image is formed on the surface of the sensitizer drum 41 as it is irradiated with laser beams by the exposing device 43. The electrostatic latent image becomes an apparent image as the toner adheres to the electrostatic latent image on the sensitizer drum 41 in accordance with the rotation of the sensitizer drum 41. The developing device 44 has developing rollers 48 of cyan (C), magenta (M), yellow (Y), and black (K) respectively. The toner images of these colors thus becoming apparent images are then transported to the transferring unit 49 where they are transferred onto the intermediate transfer belt 45 one after the other to be overlaid on top of each other. The overlaid color images are then transferred onto the printing paper supplied by the paper supply unit 50. The toner images are then fixed on the printing paper by the fixing device 47 and transported to the paper discharge unit 60.

The paper supply unit 50 has a plurality of sheet supply trays 51-54. The sheet supply tray 54 is a manual feed sheet supply tray. The paper discharge unit 60 is equipped with a plurality of paper discharge trays 61-64. The paper discharge unit 60 may have a post-processing unit for providing post-processes such as punching or stapling to the printing paper transported there.

Figure 6:
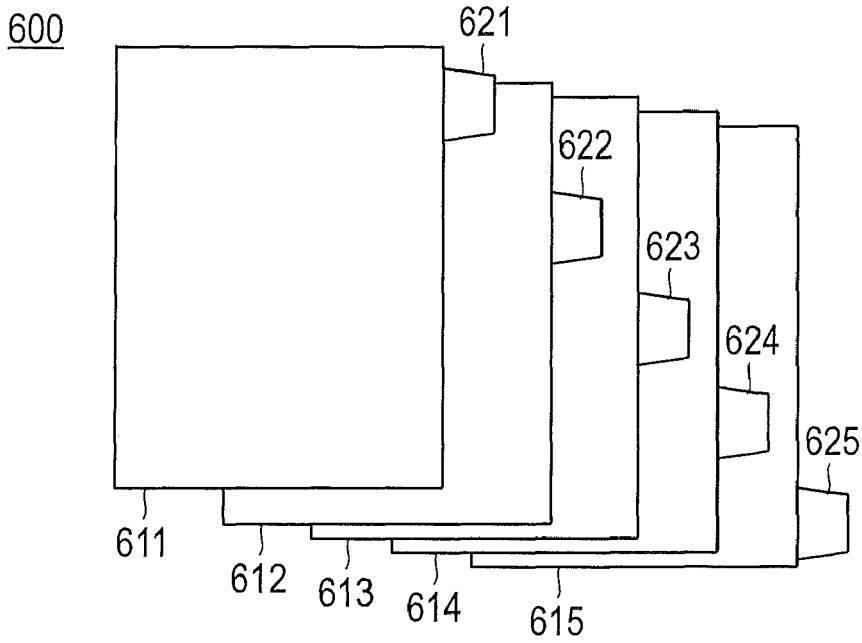
FIG. 6 is a diagram showing tab sheets used in this embodiment.

FIG. 6 is a diagram showing tab sheets used in this embodiment, for example, five-tab sheets 600. Tab sheets are also called index sheets. As shown in FIG. 6, the tab sheet 600 is a set consisting of five sheets 611-615 and is called a "five-tab." Each of the tab sheets 611-615 has a flat rectangular main body and a tab 621-625 respectively protruding at a specified position on a side of said may body.

The order of the tab sheets shown in FIG. 6 is called the normal order and is arranged in such a way that the tab of an upper layer sheet is found above the tab of a lower layer sheet in FIG. 6 when all of their tabs are on the right side. In case of the five-tab tab sheet 600, the tabs 621-625 are provided on one side of the main body lowering their positions sequentially in five steps from the top to the bottom. The positions of the tabs 621, 622, 623, 624, and 625 are identified as 1/5 (one-fifth), 2/5 (two-fifths), 3/5 (three-fifths), 4/5 (four-fifths), and 5/5 (five-fifths) respectively. The tab sheets 600 are normally provided in multiple sets in the sheet supply tray.

The operation of the network system in this embodiment will be described in the following.

Figure 7:
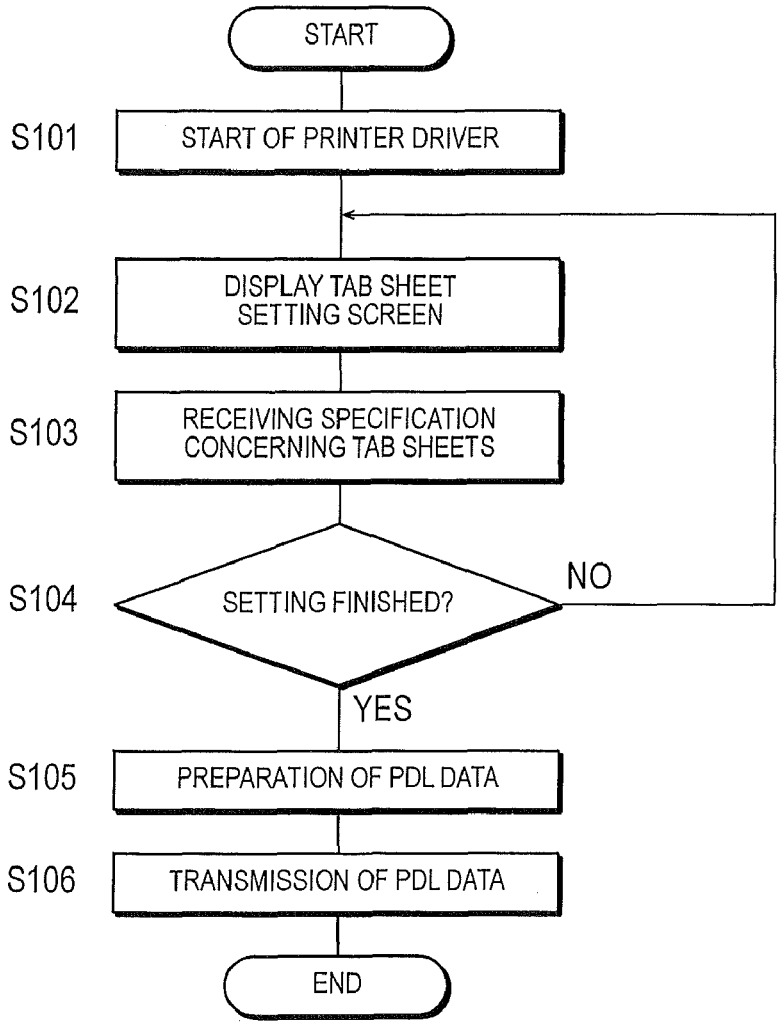
FIG. 7 is a flow chart showing the process procedure on the PC.

FIG. 7 is a flow chart showing the process procedure on the PC 1. The algorithm shown in the flowchart of FIG. 7 is stored as a program in a storage unit such as a hard disk 14 of the PC 1 and executed by the CPU 11.

As a preamble, a document file to be printed is prepared by the PC 1. The document file is prepared by an application installed on the PC 1.

When the printing process for a document file is executed, the printer driver is activated via printing setting dialogs of the application based on the user's operation (S101).

Next, when a selection tab 101 (refer to FIG. 8) is clicked on the printing setting screen which is displayed by the printer driver, the tab paper setting start request is accepted and the tab sheet setting screen will be displayed on the display 15 (S102).

Figure 8:
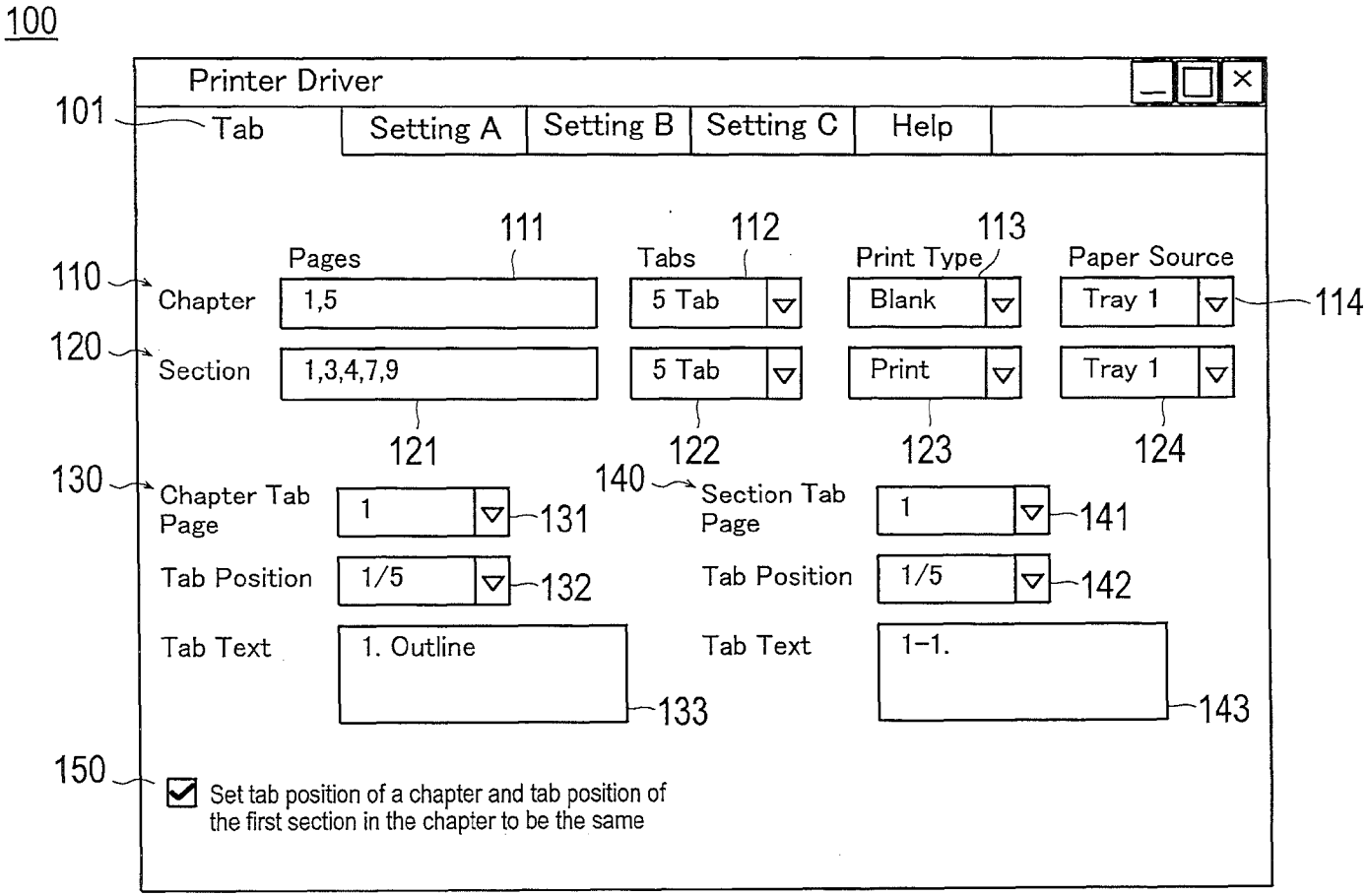
FIG. 8 is a diagram showing an example tab sheet setting screen.

FIG. 8 is a diagram showing an example tab sheet setting screen 100.

The tab sheet setting screen 100 has a first tab sheet insertion setting part 110 for setting up the insertion of chapter tab sheets as the major division tab sheets to be inserted at the breakpoints of "chapters," i.e., the first level breaks of a document, which is the object of printing, and a second tab sheet insertion setting part 120 for setting up the insertion of section tab sheets as the minor division tab sheets to be inserted at the breakpoints of "sections," i.e., the second level breaks of the document.

The first tab sheet insertion setting part 110 includes a first insertion page position setting part 111 which the user can use to specify the insertion page position where a tab sheet is inserted, and the second tab sheet insertion setting part 120 includes a second insertion page position setting part 121 which the user can use to specify the insertion page position where a section tab sheet is to be inserted. Here the term "page" signifies a page of a document which is the object of the printing process and is a notion that does not include the tab paper. In the present embodiment, the tab sheet is inserted behind the page designated as the insertion page position in the setting process. However, the tab sheet can be inserted in front of the page designated as the insertion page position in the setting process.

The first tab sheet insertion setting part 110 includes a first tab sheet type setting part 112 that the user can use for selecting a type of chapter tab sheet, and the second tab sheet insertion setting part 120 includes a second tab sheet type setting part 122 that the user can use for selecting a type of section tab sheet. The first tab sheet type setting part 112 and the second tab sheet type setting part 122 each displays a plurality of options for selecting the type of tab sheet. The type of tab sheet is not limited to the five-tab sheets shown in FIG. 6 and can include tab sheets consisting of various other numbers of tabs such as seven tabs and 10 tabs, or tab sheets of different colors.

In this embodiment, a case of using the same type of tab sheets in the first tab sheet type setting part 112 and the second tab sheet type setting part 122 will be described. It is also possible to provide a tab sheet type setting part which enables the user to select a tab sheet type that can be used both as a chapter tab sheet and a section tab sheet.

The first tab sheet insertion setting part 110 also includes a first tab printing setting part 113 for setting up whether any printing is to be executed on the tab of the tab sheet, and the second tab sheet insertion setting part 120 includes a second tab printing setting part 123 for setting up whether any printing is to be executed on the tab of the tab sheet The available options here are "Print" and "Blank," where selecting "Print" causes the tab to be printed and selecting "Blank" causes the tab not to be printed.

The first tab sheet insertion setting part 110 includes a first sheet supply tray setting part 114 that the user can use for selecting a chapter tab sheet supply tray, and the second tab sheet insertion setting part 120 includes a second sheet supply tray setting part 124 that the user can use for selecting a section tab sheet supply tray. The first sheet supply tray setting part 114 and the second sheet supply tray setting part 124 each displays a plurality of options for selecting sheet supply trays. Here "Tray 1" designates a sheet supply tray 51 and "Tray 2" designates a sheet supply tray 52 (see FIG. 5).

In this embodiment, a case when the same sheet supply tray is selected in the first sheet supply tray setting part 114 and in the second sheet supply tray setting part 124 will be described. It is also possible to provide a tab sheet type setting part which enables the user to select a sheet supply tray that can be used both for a chapter tab sheet and a section tab sheet.

The tab sheet setting screen 100 further has a first tab sheet setting part 130 for setting up a chapter tab sheet that corresponds to the inserting page position set up in the first insertion page position setting part 111, and a second tab sheet setting part 140 for setting up a section tab sheet that corresponds to the inserting page position set up in the second insertion page position setting part 121.

The first tab sheet setting part 130 includes a first object page position setting part 131 that the user can use for designating an object page position in the setting process, and the second sheet setting part 140 includes a second object page position setting part 141 that the user can use for designating an object page position in the setting process. Here the first object page position setting part 131 selectably displays the insertion page position set up in the first page position setting part 111. For example, in case of FIG. 8, the first object page position setting part 131 displays two options of page 1 or 5. The second object page position setting part 141 selectably displays the insertion page position set up in the second page position setting part 121. For example, in case of FIG. 8, the second object page position setting part 141 displays five options of page 1, 3, 4, 7, or 9.

Also, the first tab sheet setting part 130 includes a first tab position display part 132 for displaying the tab position in the chapter tab sheet that corresponds to the insertion page position set up in the first insertion page position setting part 111. On the other hand, the second tab sheet setting part 140 includes a second tab position display part 142 for displaying the tab position in the chapter tab sheet that corresponds to the insertion page position set up in the second insertion page position setting part 121.

The first tab sheet setting part 130 includes a first tab printing information setting part 133 for specifying the tab printing information on the chapter tab sheet that corresponds to the insertion page position specified in the first insertion page position setting part 111, and the second tab sheet setting part 140 includes a second tab printing information setting part 143 for specifying the tab printing information on the tab sheet that corresponds to the insertion page position specified in the second insertion page position setting part 121.

In this embodiment, the position of the tab in the chapter tab sheet that corresponds to the insertion page specified in the first insertion page position setting part 111 is set up automatically to descend from the top to the bottom on one side of the main body, i.e., in the order the tab sheets are aligned, and the tab position setup is displayed in the first tab position display part 132.

Also, the tab sheet setting screen 100 includes a checkbox 150 that enables the user to specify the tab position for the chapter break to coincide with the position of the first section of the same chapter. In other words, in a case when the tab sheet to be inserted next changes from the chapter tab sheet to the section tab sheet, the checkbox 150 is checked if the tab sheet having the same tab position as the chapter tab sheet immediately prior to the change is to be specified by the user as the section tab sheet to be inserted. If the checkbox 150 is not checked in this embodiment and the tab sheet shall change from the chapter tab sheet to the section tab sheet, first, the tab sheet that has the next tab position relative to the chapter tab sheet immediately prior to the change shall be specified as the section tab sheet to be inserted.

Therefore, in this embodiment, relative to the tab position on the section tab sheet corresponding to the insertion page position specified in the second insertion page position setting part 121, the tab position of the first section tab sheet in case the tab sheet to be inserted next changes from the chapter tab sheet to the section tab sheet is specified based on whether or not the checkbox 150 is checked, the tab position of the succeeding section tab sheet is set up automatically in the order the tab sheets are aligned, and the tab position set up is displayed in the second tab position display part 142.

The first tab position display part 132 and the second tab position display part 142 can be omitted. It is because the tab position of the chapter tab sheet can be grasped by the printing system 4 based on the insertion page position specified in the first insertion page position setting part 111, and the type of tab sheet selected at the first tab sheet type setting part 112, and the tab position of the section tab sheet can be grasped by the printing system 4 based on the insertion page position specified in the second insertion page position setting part 121, the tab type selected by the second tab sheet type setting part 122, and whether or not the checkbox 150 is checked.

Getting back to the flowchart shown in FIG. 7, the user's specification concerning the tab sheet is received using the tab sheet setting screen 100 in step S103.

In step S104, a judgment is made as to whether the setting work on the tab sheet setting screen 100 has been completed or not. For example, when the display is switched to a different printing setting screen from the tab sheet setting screen 100 and the instruction button for printing start (not shown) is clicked, it is judged that the setting work at the tab sheet setting screen 100 is finished. If the setting work at the tab sheet setting screen 100 has not been completed (S104: No), the system returns to step S102.

If the setting work at the tab sheet setting screen 100 has been completed (S104: Yes), PDL data is generated as the document file prepared by using the application (S105).

The setting information concerning the tab sheet obtained in step S103 is written into the PDL data as command data. Other setting information is described as command data in the PDL data.

Next, in step S106, the PDL data thus prepared is transmitted to the printer controller 2 of the printing system 4 via the network 5.

Figure 9:
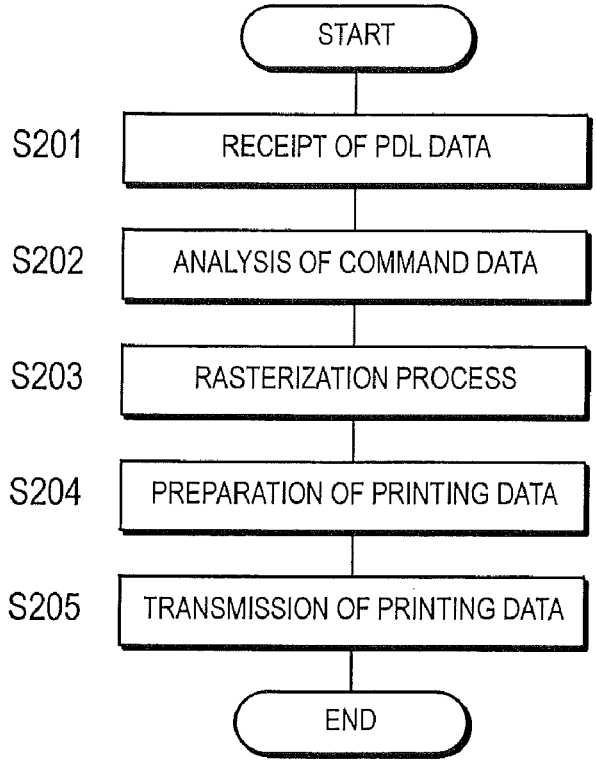
FIG. 9 is a flowchart showing the process sequence on the printer controller.

Next, the job process in the printer controller 2 will be described below referring to FIG. 9. The algorithm shown in the flowchart of FIG. 9 is stored as a program in a storage unit such as a hard disk 24 of the printer controller 2 and executed by the CPU 21.

First, the printer controller 2 receives the PDL data from the PC1 (step S201), and analyzes the command data described in the PDL data (S202). Here, the setting information concerning the tab sheet is identified as the command data is analyzed.

Next, the received PDL data is rasterized in order to obtain bitmap data, which is bitmap type image data (S203).

Printing data is then prepared by adding header information containing setting information concerning the tab sheet to the bitmap data thus obtained in step S203 (S204), and the particular printing data is transmitted to the printer 3 as a printing job (S205).

Figure 10:
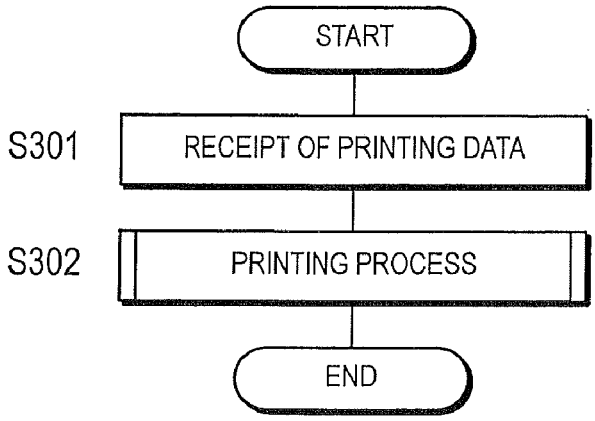
FIG. 10 is a flowchart showing the process sequence on the printer.

Next, the job process in the printer 3 will be described below referring to FIGS. 10-12. The algorithm shown in the flowcharts of FIGS. 10-12 is stored as a program in a storage unit such as a ROM 32 of the printer 3 and executed by the CPU 31.

The printer 3 receives the printing data from the printer controller 2 as the printing job (step S301). Next, the printer 3 executes the printing process (S302).

Figure 11:
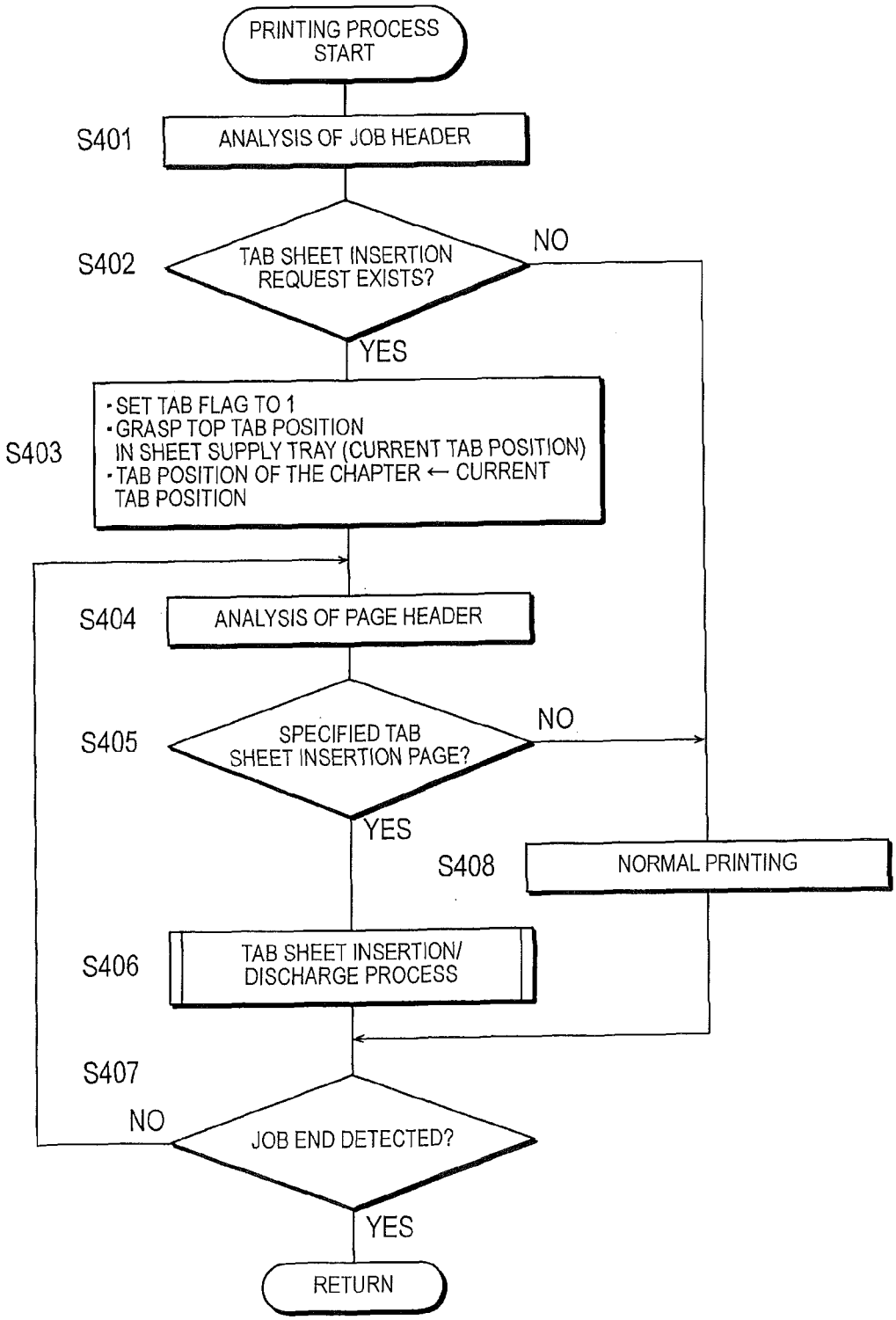
FIG. 11 is a flowchart showing the procedure of the printing process.
Figure 12:
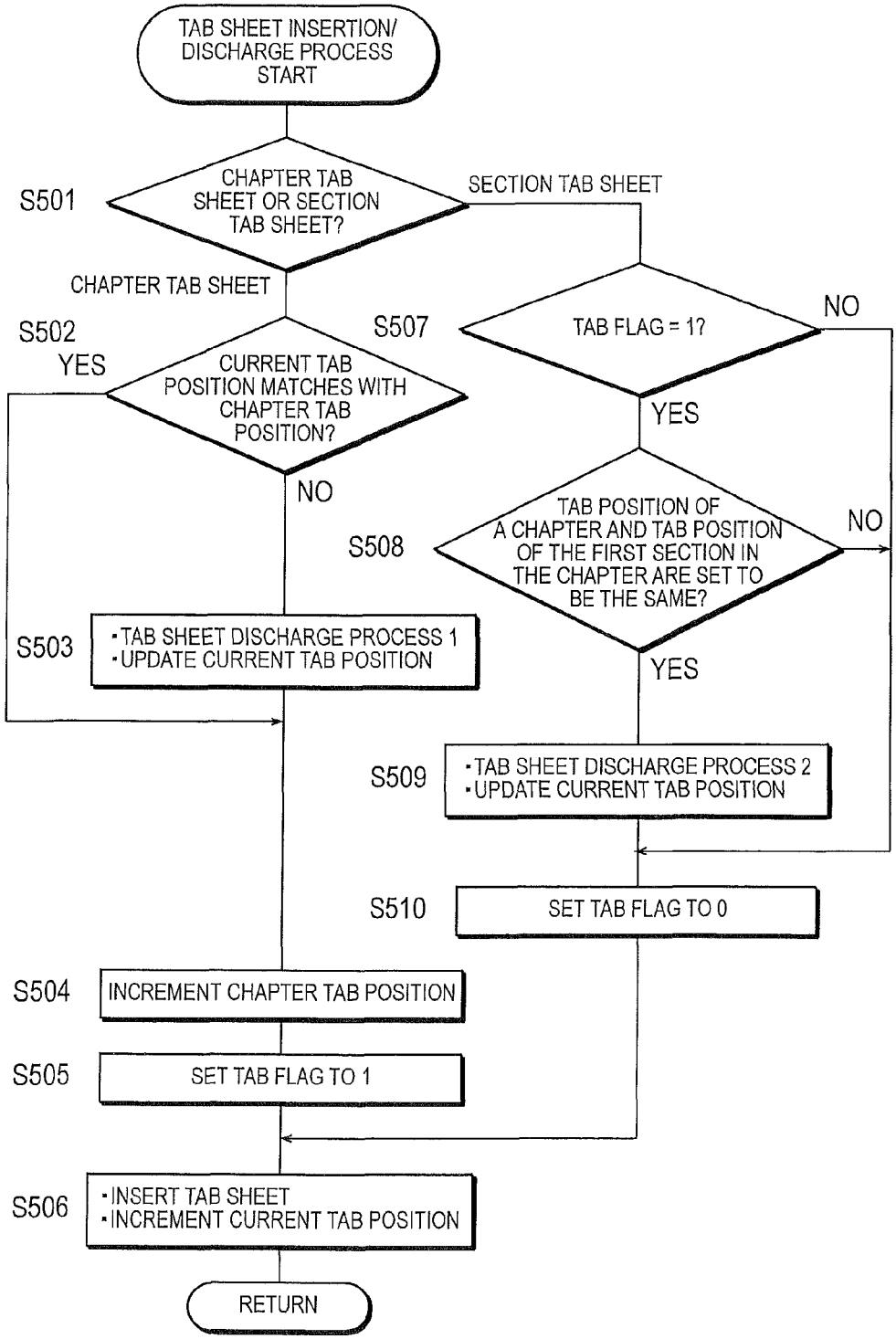
FIG. 12 is a flowchart showing the inserting/discharging process procedure of tab sheets.

As the printing process is initiated, the job header contained in the header information is first analyzed as shown in FIG. 11 (S401).

Based on the analysis of the job header, a judgment is made whether or not there is a demand for tab sheet insertion in step S402.

If there is no request for tab sheet insertion (S402: No), normal printing, i.e., printing of one page portion is executed (S408), and the program advances to step S407.

On the other hand, if there is a tab sheet insertion request (S402: Yes), the tab flag is set to "1" (S403). At this point, the tab flag is set to "1" in case of a chapter tab sheet, and "0" in case of a section tab sheet. Also, the tab position of the top tab sheet in the sheet supply tray 51 ("current tab position") is grasped. A case when the leading tab position (e.g., ⅕ of the five-tab), which is the default value, is grasped as the "current tab position" will be described here. Also, the same value as the "current tab position" is set for the "chapter tab position) here. Incidentally, the "current tab position" and the "chapter tab position" are stored in the memory unit such as the RAM 33 of the printer 3.

Next, the page header is analyzed (S404). The analysis of the page header is conducted for each page sequentially in accordance with the description of the printing job in sequence. The process concerning a tab sheet is executed as a process on a tab sheet insertion page, i.e., a tab page, separate from the process on normal pages of a printing job.

Based on the analysis of the page header, a judgment is made whether or not it is a page assigned as a page for tab sheet insertion, i.e., a tab page (S405).

If it is not a page assigned for tab sheet insertion (S405: No), normal printing, i.e., printing of one page portion is executed (S408), and the program advances to step S407.

On the other hand, if it is a page assigned for tab sheet insertion (S405: Yes), the tab sheet insertion/discharge process is executed (S406). The details of the tab sheet insertion/discharge process will be described later.

In step S407, a judgment is made as to whether the job end of the printing data is detected or not. In other words, it is judged whether all the processes concerning the printing data have been completed or not.

If the job end is not detected (S407: No), the program returns to step S404 and executes the next page's process. On the other hand, if the job end is detected in step S407 (S407: Yes), it returns to the flow chart shown in FIG. 10.

Next, let us describe the tab sheet insertion/discharge process with reference to FIG. 12.

First, when it is judged to be a page assigned for tab sheet insertion in S405, a judgment is made whether the current tab sheet is a chapter tab sheet or a section tab sheet (S501).

If it is judged to be a chapter tab sheet (S501: chapter tab sheet), a judgment is made whether the "current tab position" is the same as the "chapter tab position" or not (S502).

For example, if it is judged that the "current tab position" is the same as the "chapter tab position" (S502: Yes) as in the case of a chapter tab sheet, which is to be inserted at the start of a printed matter, the program advances to step S504.

On the contrary, if it is judged that the "current tab position" is not the same as the "chapter tab position" (S502: No)

as in the case of a chapter tab sheet, which is to be inserted in the second time in a printed matter and a section tab sheet exists before it, the program advances to step S503.

In step S503, the tab sheet discharge process 1 is executed. In other words, the tab sheets contained in the sheet supply tray 51 are discharged as unnecessary tab sheets until the tab position of the tab sheet to be supplied next from the sheet supply tray matches with the tab position of the chapter tab sheet to be inserted next. Here, the unnecessary tab sheet means tab sheet that became no longer necessary. At this point, the unnecessary tab sheets are discharged to a discharge tray which is different from the discharge destination of the printed matter based on normal pages of a printing job. Also, the "current tab position" is updated, i.e., incremented by 1/Tab number equivalent to the number of discharges of the tab sheets as unnecessary tab sheets. In this case, the Tab number is the number of tab sheets of one set whose tab positions are different, and it is also called as the index number. If the tab position exceeds "1," it is determined as the leading tab position (hereinafter the same).

In step S504, the "chapter tab position" is incremented.

Next, the tab flag is set to "1" (S505), and the program advances to step S506.

In step S506, a tab sheet is supplied from the specified sheet supply tray (sheet supply tray 51 in case of FIG. 8), and inserted in the specified page position. When there is a printing instruction for the tab, this tab sheet is discharged to the same sheet discharge tray as the one for the printed matter based on normal pages of the printing job after the particular printing is finished. Next, the "current tab position" is incremented by 1/Tab number, and returns to the flow chart shown in FIG. 11.

On the other hand, if it is judged that it is a section tab sheet in step S501 (S501: section tab sheet), a judgment is made as to whether the tab flag is "1" or not (S507).

For example, if the tab flag is not "1" in step S507 as in the case of inserting a section sheet following the insertion of section tab sheet in the previous time, the program advances to step S510.

For example, if the tab flag is judged to be "1" in step S507 as in the case of the tab sheet to be inserted next changes from a chapter tab sheet to a section tab sheet, the program advances to step S508.

In steps S508, a judgment is made as to whether or not the tab position of a chapter is set up the same as that of the first section of the particular chapter.

If it is judged in step S508 that the tab position of a chapter is not set up the same as that of the first section of the particular chapter (S508: No), the program advances to step S510. This is because it is judged that the tab sheet to be inserted next changes from a chapter tab sheet to a section tab sheet, and it is specified to insert a tab sheet with a tab position which is the next tab position relative to the chapter tab sheet immediately prior to the change.

If it is judged in step S508 that the tab position of a chapter is set up the same as that of the first section of the particular chapter (S508: Yes), the program advances to step S509.

In step S509, the tab sheet discharge process 2 is executed. In other words, the tab sheets contained in the sheet supply tray 51 are discharged as unnecessary tab sheets until the tab position of the tab sheet to be supplied next from the sheet supply tray matches with the tab position of the chapter tab sheet to be inserted next just prior to a change from a chapter tab sheet to a section tab sheet. At this point, the unnecessary tab sheets are discharged to a discharge tray which is different from the discharge destination of the printed matter based on normal pages of a printing job. Also, the "current tab position" is updated, i.e., incremented by 1/Tab number equivalent to the number of discharges of the tab sheets as unnecessary tab sheets.

Next, the tab flag is set to "0" (S510), and the program advances to step S506.

Figure 13:
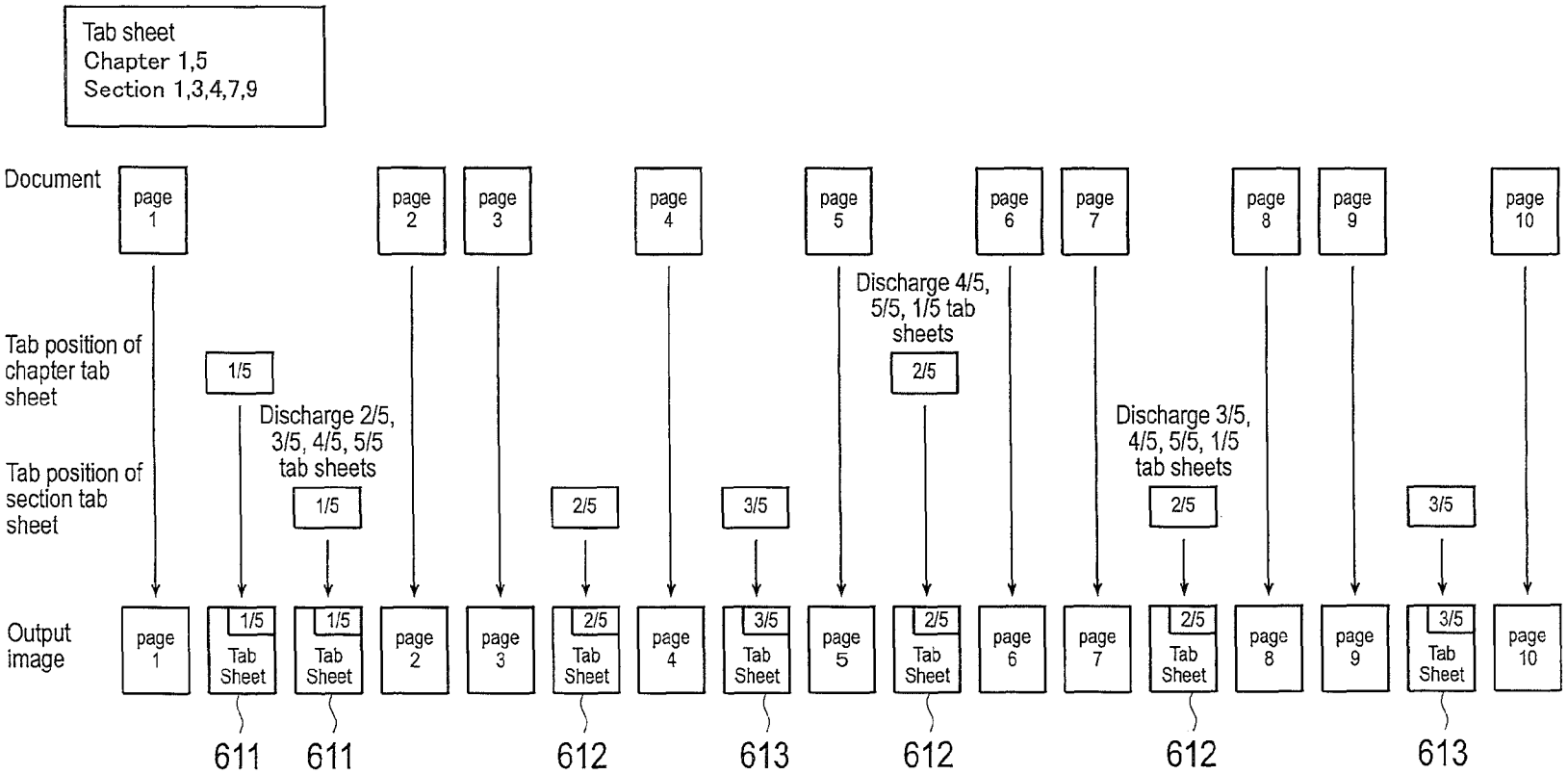
FIG. 13 is an explanatory diagram for describing an example of printed matters prepared in accordance with the first embodiment.

FIG. 13 is an explanatory diagram for describing an example of printed matters prepared in accordance with the first embodiment. FIG. 13 shows an example of a case where the checkbox 150 shown in FIG. 8 is checked. In the example of FIG. 13, the tab position of the chapter tab sheets is changed sequentially. Also, the tab position of the first chapter tab sheet when there is a change from a chapter to a section is the same tab position as that of the chapter tab sheet just prior to the change, and the tab position of the section tab sheets to be inserted next is changed sequentially.

Figure 14:
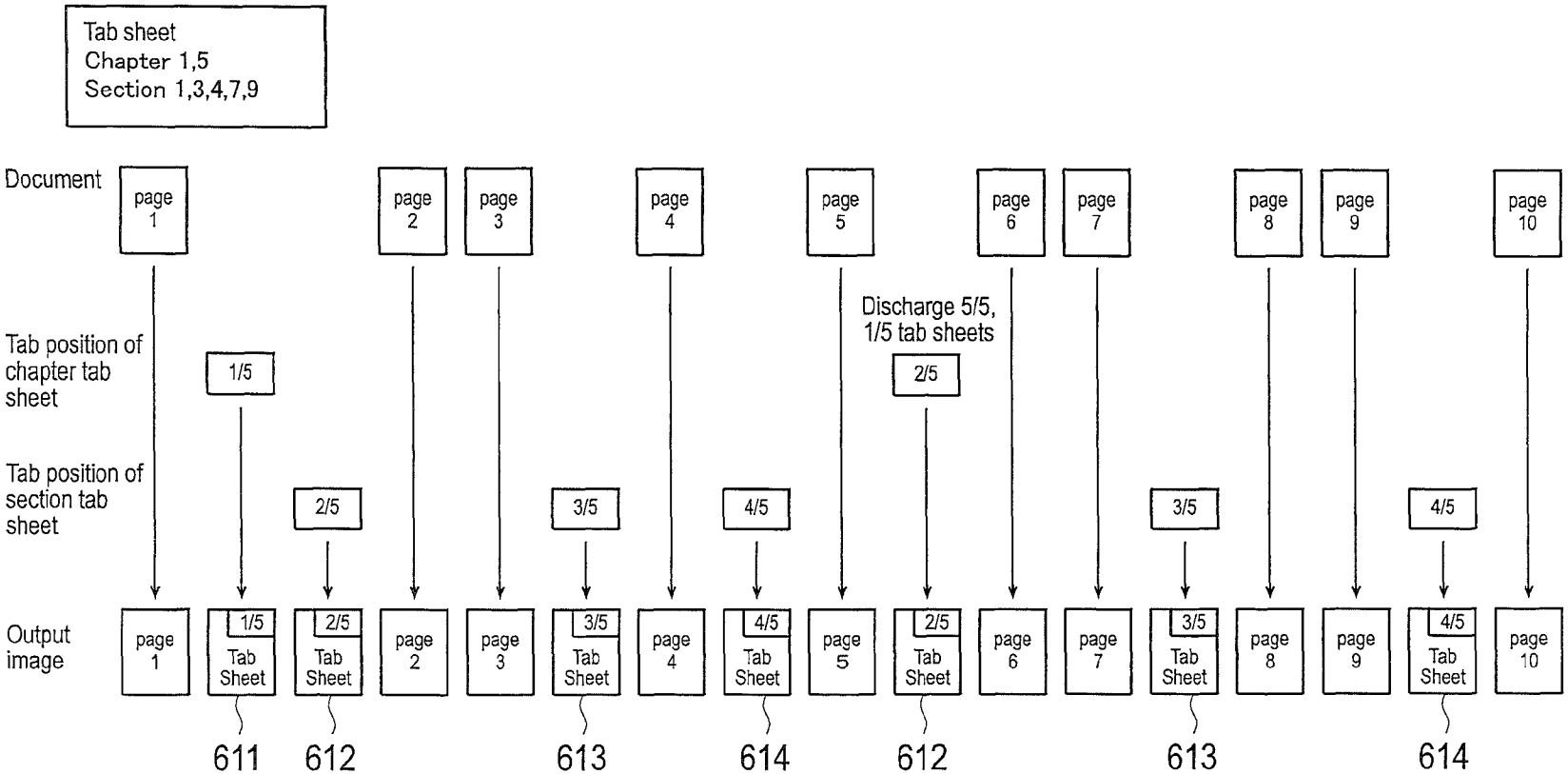
FIG. 14 is an explanatory diagram for describing another example of printed matters prepared in accordance with the first embodiment.

FIG. 14 is an explanatory diagram for describing another example of printed matters prepared in accordance with the first embodiment. FIG. 14 shows an example of a case where the checkbox 150 shown in FIG. 8 is not checked. In the example of FIG. 14, the tab position of the chapter tab sheets is changed sequentially. Also, the tab position of the first chapter tab sheet when there is a change from a chapter to a section becomes the next tab position relative to that of the chapter tab sheet just prior to the change, and the tab position of the section tab sheets to be inserted next is changed sequentially.

As described above, in the first embodiment, the tab sheets of the same type are supplied from the same sheet supply tray. Moreover, during the printing of a document, if the tab position of the tab sheet to be supplied next from the sheet supply tray does not match with the tab position of the tab sheet to be inserted next, the tab sheets contained in the sheet supply tray are discharged as unnecessary tab sheets until those two tab positions match.

Therefore, the tab sheets as a constituent with the sequentially offset tab position is not inserted into a printed matter in the order of their stacking in the sheet supply tray, but rather the tab position change mode for the tab sheet to be inserted can be adjusted based on whether it is a chapter tab sheet or a section tab sheet. In other words, even if the tab sheets of the same type are supplied from the same sheet supply tray, a tab sheet can be used differently as the chapter tab sheet and as the section tab sheet.

Consequently, even when the tab sheets of the same type are supplied from the same sheet supply tray, the user can differentiate a chapter tab sheet from a section tab sheet in a finished printed matter by just looking at them, so that it is possible to find a desired page of the printed matter easily and quickly based on the tab sheets.

Next, the second embodiment will be described below focusing primarily on the points different from the first embodiment.

In the second embodiment, the user can specify the tab position range for the tab sheets to be used as the chapter tab sheets as well as the tab position range for the tab sheets to be used as the section tab sheets.

The flowchart shown in FIG. 7, same as in the first embodiment, shows the procedures of the process on the PC 1 in the second embodiment.

In step S102 in FIG. 7, when the selection tab 101 (refer to FIG. 15) is clicked on the printing setting screen which is displayed by the printer driver, the tab paper setting start request is accepted and the tab sheet setting screen will be displayed on the display 15.

Figure 15:
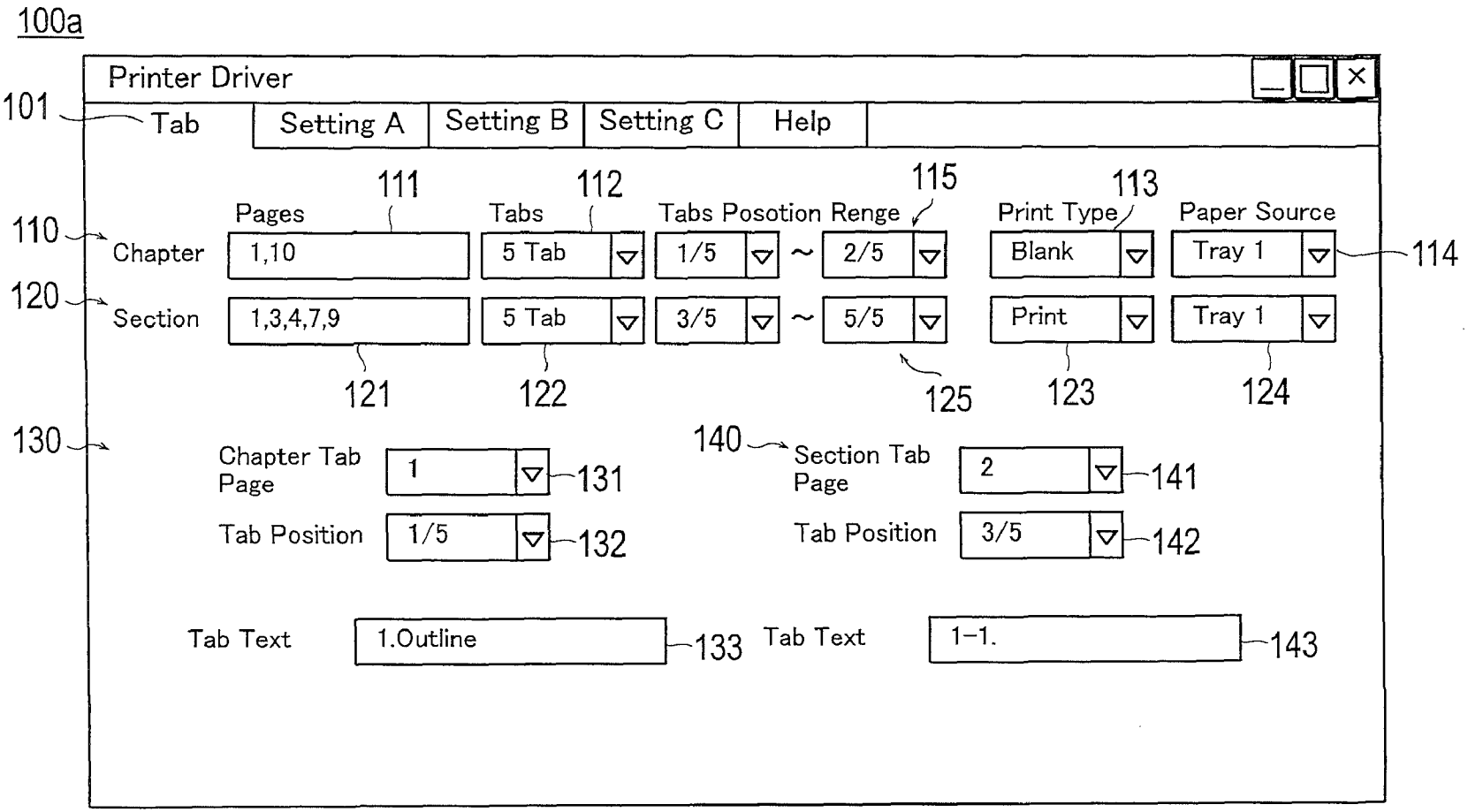
FIG. 15 is an example of tab sheet setting screen in a second embodiment.

FIG. 15 is an example of tab sheet setting screen 100*a* in the second embodiment.

In the tab sheet setting screen 100*a*, a first tab sheet insertion setting part 110 contains a first tab position range setting part 115 that enables the user to specify a first tab position range that represents the range of the tab positions of tab sheets to be used as chapter tab sheets, and a second tab sheet insertion setting part 120 contains a second tab position range setting part 125 that enables the user to specify a second tab position range that represents the range of the tab positions of tab sheets to be used as section tab sheets. However, the tab sheet setting screen 100*a* does not contain the checkbox 150 such as the one included in the tab sheet setting screen 100 in the first embodiment.

Moreover, in the second embodiment, the tab sheets are different from those in the first embodiment in that they are inserted in front of the pages designated by the insertion page positions that are set up. However, the tab sheet can be inserted behind the page designated as the insertion page position in the setting process.

In step S103 in FIG. 7, the user's specification concerning the tab sheet is received using the tab sheet setting screen 100*a*.

As shown in FIG. 15, the front half tab positions are allocated for the first tab position range considering the use for chapter tabs. The rear half tab positions are allocated for the second tab position range considering the use for section tabs. In case of FIG. 15, the first tab position range is allocated to ⅕a-⅖, and the second tab position range to ⅗-⅘

The flowchart shown in FIG. 9 shows, same as in the first embodiment, the procedures of the process on a printer controller 2 in the second embodiment. The flowchart shown in FIG. 10 shows the procedures of the process on a printer 3 in the second embodiment.

The flowchart shown in FIG. 11 shows the procedures of the printing process (step S302) in the second embodiment similar to the first embodiment.

As the printing process is initiated, the job header contained in the header information is first analyzed in step S401 of FIG. 11.

Figure 16:
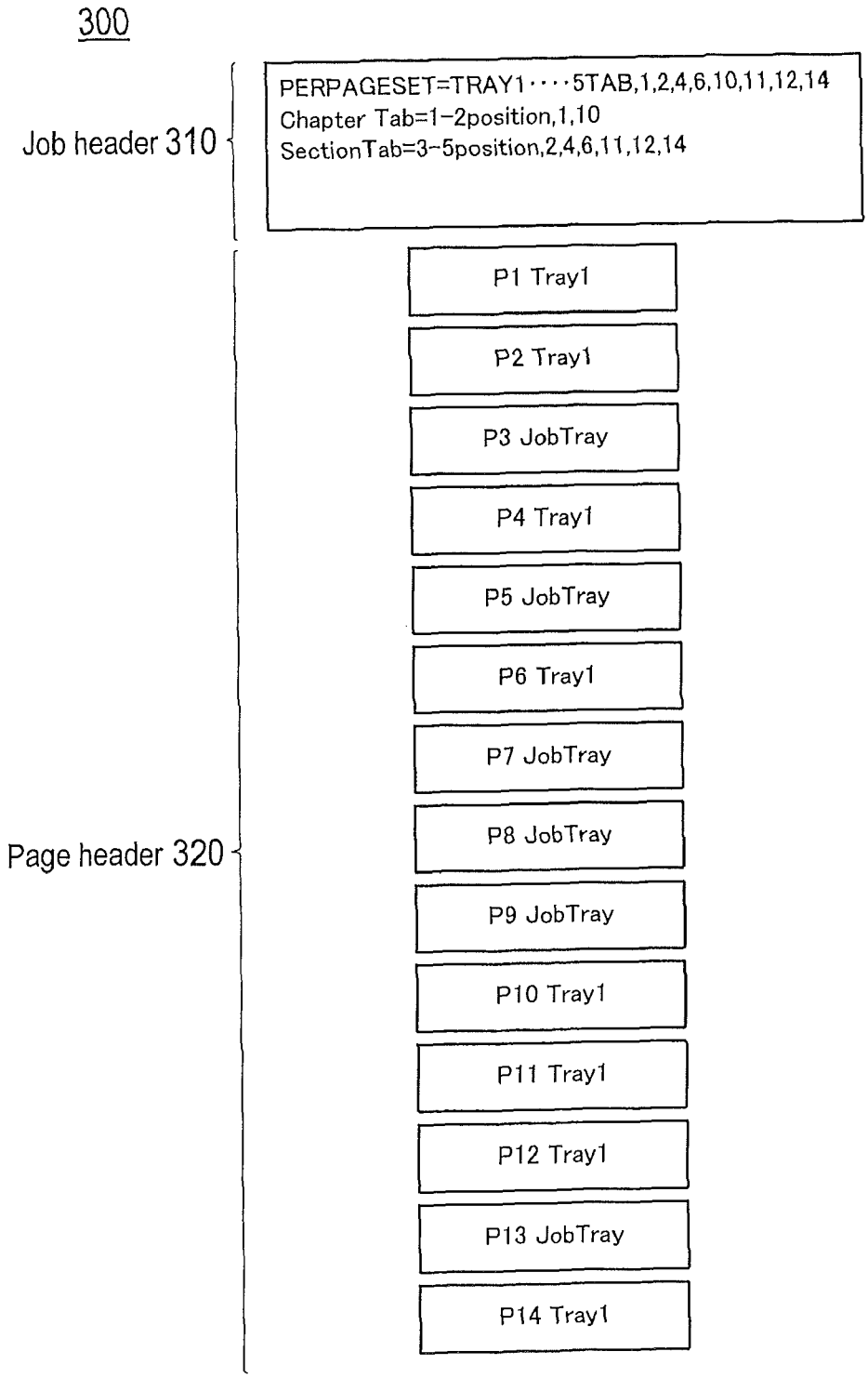
FIG. 16 is a conceptual diagram of the header information in case of the second embodiment.

FIG. 16 is a conceptual diagram of the header information in case of the second embodiment. The header information 300 comprises a job header 310 which is an additional information related to the entire printing job and a job header 320 which is an additional information related to specific pages included in the printing job.

For example, the job header 310 in FIG. 16 contains the setting information concerning the tab sheets consisting of the following contents. In other words, the supply source of the tab sheets (chapter tab sheets and section tab sheets) is "Tray 1" (sheet supply tray 51 of FIG. 5), the tab sheet type is five-tab, and the insertion page positions for the tab sheets are pages 1, 2, 4, 6, 10, 11, 12, and 14. Also, the range of the tab position of the tab sheets to be used as the chapter tab sheet is ⅕-⅖, and the insertion page position of the tab sheets to be used as the chapter tab sheetare pages 1 and 10. Also, the range of the tab position of the tab sheets to be used as the section tab sheet is ⅗-⅖, and the insertion page position of the tab sheets to be used as the section tab sheet are pages 2, 4, 6, 11, 12 and 14.

Moreover, in the page header 320 of FIG. 16, "P1," "P2," . . . are the common page numbers of the document to be printed. "Tray1" is the sheet supply tray for the tab sheets to be inserted at those page positions. "JobTray" indicates that there is no tab sheet to be inserted at the particular page position there, and the sheet to be used for printing the page is supplied from the sheet supply tray specified in the printing job.

Figure 17:
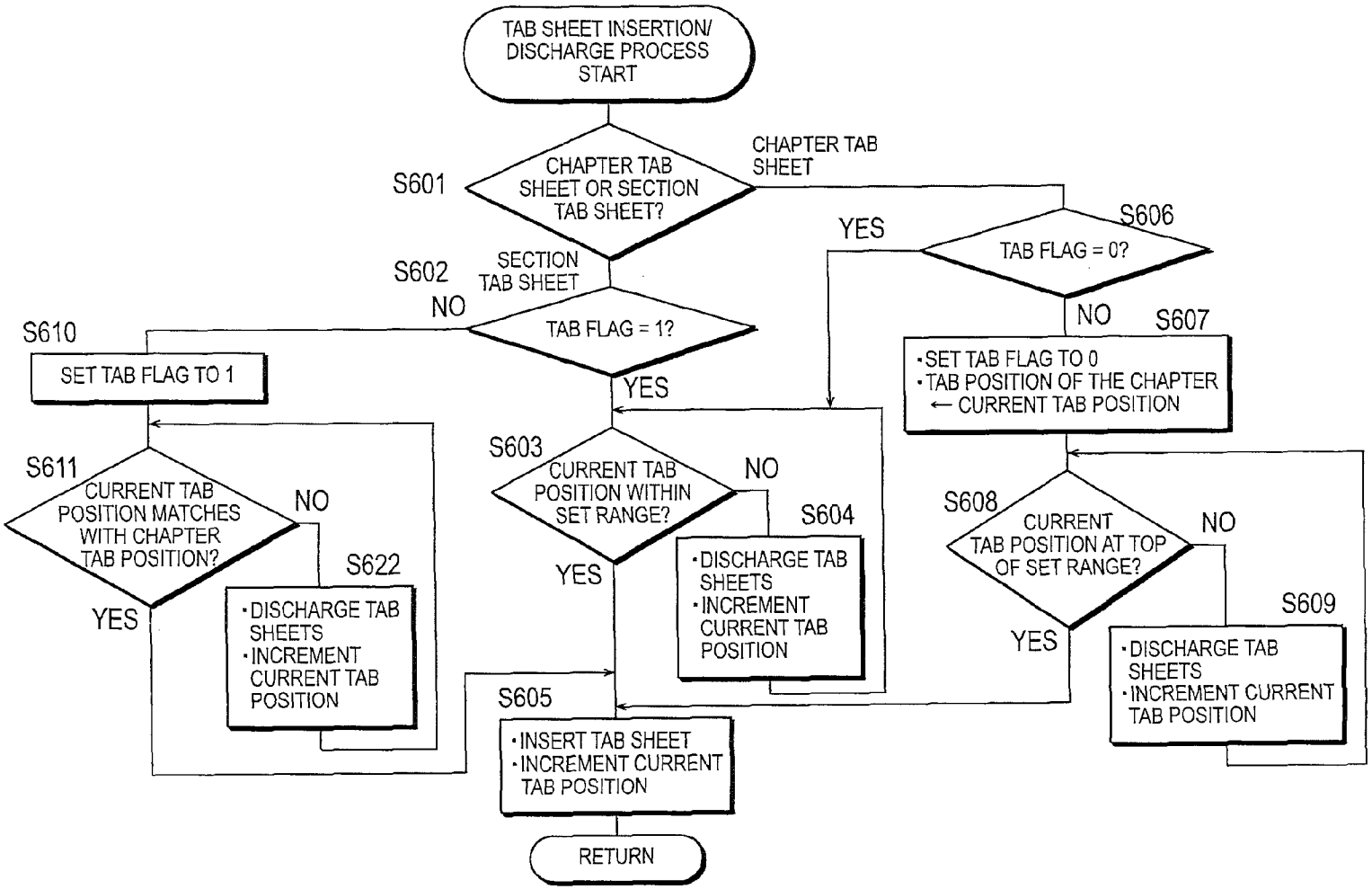
FIG. 17 is a flowchart showing the inserting/discharging process procedure of tab sheets in case of the second embodiment.

Next, let us describe the tab sheet insertion/discharge process in the second embodiment with reference to FIG. 17.

First, when it is judged to be a page assigned for tab sheet insertion in S405 shown in FIG. 11, a judgment is made whether the current tab sheet is a chapter tab sheet or a section tab sheet (S601).

If it is judged that it is a chapter tab sheet (S601: chapter tab sheet), a judgment is made as to whether the tab flag is "1" or not (S602).

For example, if it is judged that the tab flag is "1" in step S602 (S602: Yes) as in the case of a chapter tab sheet is first inserted in the printed matter, or if a chapter tab sheet is inserted again after a chapter tab sheet is first inserted in the printed matter, the program advances to step S603.

In the step S603, a judgment is made whether or not the "current tab position" is within the specified first tab position range in case of a chapter tab sheet, or within the specified second tab position range in case of a section tab sheet. If the "current tab position" is not within the specified range (S603: No), a tab sheet in the specified sheet supply tray 51 is discharged as an unnecessary tab sheet (S604). At this point, the unnecessary sheets are discharged to a discharge tray which is different from the discharge destination of the printed matter based on normal pages of a printing job. Also, the "current tab position" is incremented by 1/Tab number. The program then returns to step S603.

If it is judged in step S603 that the "current tab position" is within the specified range (S603: Yes), the process advances to step S605.

In step S605, a tab sheet is supplied from the specified sheet supply tray 51, and inserted in the specified page position. When there is a printing instruction for the tab, this tab sheet is discharged to the same sheet discharge tray as the one for the printed matter based on normal pages of the printing job after the particular printing is finished. Next, the "current tab position" is incremented by 1/Tab number, and returns to the flowchart shown in FIG. 11.

On the other hand, if it is judged that it is a section tab sheet in step S601 (S601: section tab sheet), a judgment is made as to whether the tab flag is "0" or not (S606).

If it is judged in step S606 that the tab flag is "0" (S606: Yes), it is judged that a section tab sheet is inserted again after a section tab sheet is inserted previously, and the program proceeds to step S603.

On the contrary, if it is judged that the tab flag is not "0" (S606: No) in step S606, it is judged that a chapter tab sheet is inserted this time after a section tab sheet is inserted previously, and the tab flag is set to "0" (S607). Also, the same value as the "current tab position" is set for the "chapter tab position" here. Thus, the "chapter tab position" at this time is stored. The program then returns to step S608.

In the step S608, a judgment is made as to whether or not the "current tab position" is the leading tab position within the specified second tab position range (⅗ in case of FIG. 15). If the "current tab position" is not within the specified range (S608: No), a tab sheet in the specified sheet supply tray 51 is discharged as an unnecessary tab sheet (S609). At this point, the unnecessary sheets are discharged to a discharge tray which is different from the discharge destination of the printed matter based on normal pages of a printing job. Also, the "current tab position" is incremented by 1/Tab number. The program then returns to step S608.

If it is judged in step S608 that the "current tab position" is the leading tab position within the specified range (S603: Yes), the process advances to step S605.

On the contrary, if it is judged in step S602 that the tab flag is not "1" (S602: No), it is judged that a chapter tab sheet is inserted this time after a section tab sheet is inserted previously, the tab flag is set to "1," and the program advances to step S611.

In step S611, a judgment is made as to whether or not the "current tab position" matches with the "chapter tab position." If the "current tab position" does not match with the "chapter tab position" (S611: No), a tab sheet in the specified sheet supply tray 51 is discharged as an unnecessary tab sheet (S622). At this point, the unnecessary sheets are discharged to a discharge tray which is different from the discharge destination of the printed matter based on normal pages of a printing job. Also, the "current tab position" is incremented by 1/Tab number. The program then returns to step S611.

If it is judged in step S611 that the "current tab position" matches with the "chapter tab position" (S611: Yes), the process advances to step S605.

As described above, the tab sheets of the same type are supplied from the same sheet supply tray in the second embodiment as well. When a document is printed, a judgment is made as to whether or not the tab position of a tab sheet to be supplied next from a sheet supply tray matches with the tab position of a tab sheet to be inserted next. If the two tab positions do not match, tab sheets contained in the sheet supply tray are discharged as unnecessary tab sheets until there is a match between the two. Particularly in the second embodiment, as specified by the user, a first tab position range that represents the range of the tab positions of tab sheets to be used as chapter tab sheets, and a second tab position range that represents the range of the tab positions of tab sheets to be used as section tab sheets are acquired. Therefore, the tab position of a tab sheet to be inserted next is caused to vary sequentially within the first tab position range if it is to be used as a chapter tab sheet, and is caused to vary sequentially within the second tab position range if it is to be used as a section tab sheet.

Figure 18:
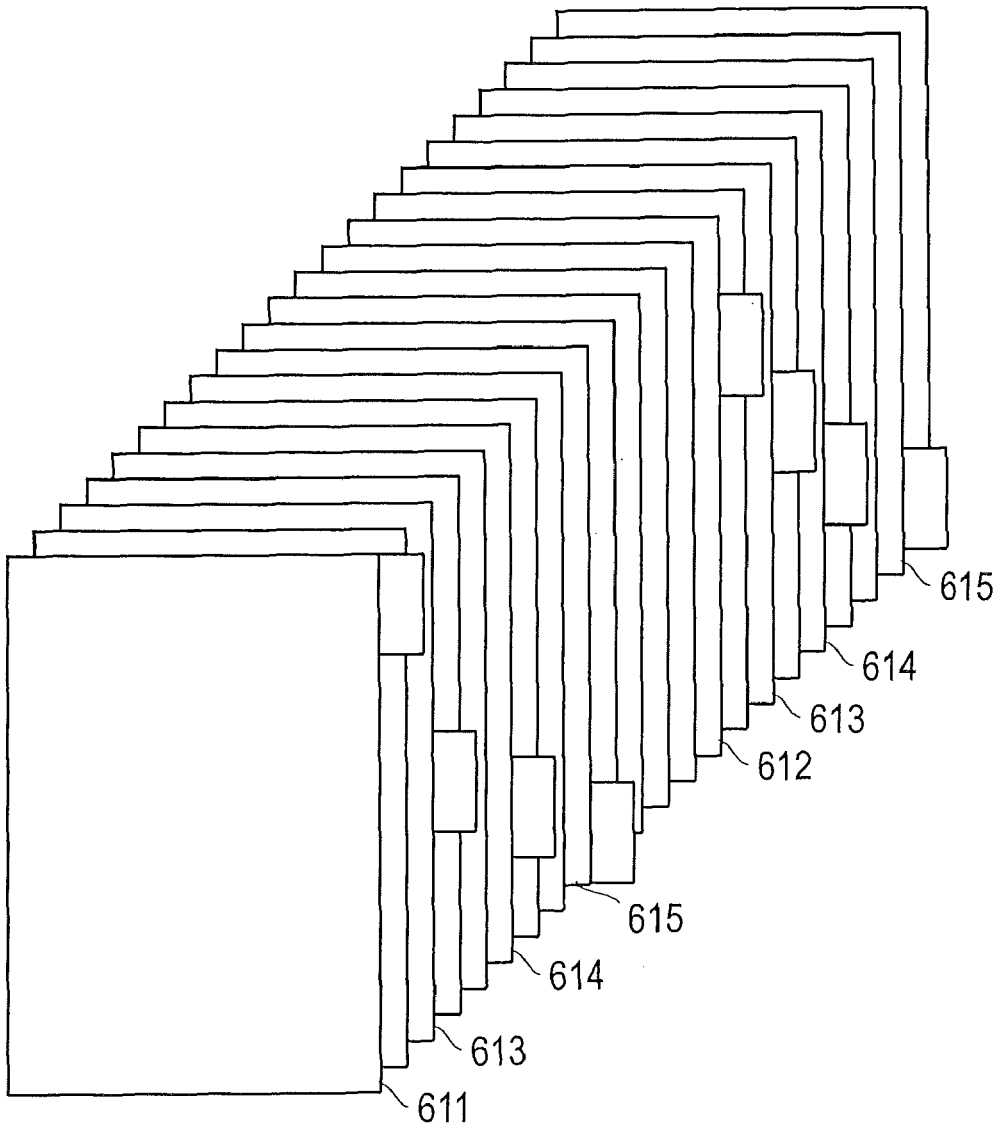
FIG. 18 is an explanatory diagram for describing an example of printed matters prepared in accordance with the second embodiment.

FIG. 18 is an explanatory diagram for describing an example of printed matters prepared in accordance with the second embodiment.

Consequently, in accordance with the second embodiment as in the first embodiment, even when the same type of tab sheets are supplied from the same sheet supply tray, the user can differentiate a chapter tab sheet from a section tab sheet in a finished printed matter by just looking at them, so that it is possible to find a desired page of the printed matter easily and quickly based on the tab sheets.

The invention is not limited to the embodiment described above, but also can be changed in various ways within the scope of the claims.

For example, although we used "chapter" and "section" as examples of breakpoints in a document in the above embodiments, the present invention is not limited to them. The breakpoints of a document can be limited to "part" and "chapter" or can include "part," "chapter," and "section," or more.

Moreover, although it is described in the above embodiment a case of the process of setting up tab sheets being executed by the printer driver, it can be executed by an application instead of the printer driver.

Further, although it is described in the above embodiment a case of the setting concerning tab sheets is conducted using the tab sheet setting screen, which is displayed on the display 15 of the PC 1, it can be executed using the tab sheet setting screen, which is displayed on the operating panel unit 34 of the printer 3.

Furthermore, although it is describe in the above embodiment a constitution wherein the printing system 4 is divided into the printer controller 2 and the printer 3, both of which are locally connected, the printer controller 2 can be built into the printer 3.

Also, although the embodiments described above uses a printer as the image forming apparatus, the invention is not limited to it. The present invention is applicable to an image forming apparatus such as MFP (Multi-Function Peripheral) and a copying machine as well.

The means and method of conducting various processes in the network system according to the present invention can be realized by means of a dedicated hardware circuit, or a programmed computer. Said program can be provided either by a computer readable recording medium such as a flexible disk and a CD-ROM, or by being supplied on-line via a network such as the Internet. In this case, the program recorded on the computer readable recording medium is normally transferred to and stored in a storage unit such as a hard disk. Said program can also be provided as independent application software or can be built into the software of the image processing device as a part of its function.

What is claimed is:

1. An image forming apparatus comprising:

a tab sheet supply unit that supplies tab sheets of an identical type from an identical sheet supply tray as a major division tab sheet to be inserted at a breakpoint of a first level of classification of a document to be printed, as well as a minor division tab sheet to be inserted at a breakpoint of a second level that is a finer level of classification than the first level of classification;

a control unit that causes the tab sheet contained in said sheet supply tray to be discharged as an unnecessary tab sheet, if the tab position of the tab sheet to be supplied next from the sheet supply tray does not match with the tab position of the tab sheet to be inserted next during the printing of said document, until both of the tab positions match; and an acquiring unit which acquires a first tab position range indicating a range of tab positions of tab sheets to be used as said major division tab sheets from a set of tab sheets and a second tab position range indicating a range of tab positions of tab sheets to be used as said minor division tab sheets from a set of tab sheets, the second tab position range being different from the first tab position range; wherein, the tab position of a tab sheet to be inserted next is caused to vary sequentially within said first tab position range if it is to be used as a major division tab sheet, and is caused to vary sequentially within said second tab position range if it is to be used as a minor division tab sheet.

2. The image forming apparatus as claimed in claim 1, wherein when a tab sheet to be inserted next changes from a minor division tab sheet to a major division tab sheet during the printing of said document, and the tab position of the tab sheet to be supplied next from said sheet supply tray does not match with the tab position of the major division tab sheet to be inserted next, said control unit causes the tab sheet contained in said sheet supply tray to be discharged as an unnecessary tab sheet until both of the tab positions match.

3. The image forming apparatus as claimed in claim 1, wherein when a tab sheet to be inserted next changes from a major division tab sheet to a minor division tab sheet during the printing of said document, said control unit causes the tab sheet contained in said sheet supply tray to be discharged as an unnecessary tab sheet until the tab position of the tab sheet to be supplied next from said sheet supply tray matches with the tab position of the major division tab sheet immediately prior to the change, and then causes a tab sheet having the same tab position as that of the major division tab sheet immediately prior to the change to be inserted as a minor division tab sheet.

4. The image forming apparatus as claimed in claim 1, wherein said control unit causes, when a tab sheet to be inserted next changes from a major division tab sheet to a minor division tab sheet during the printing of said document, a tab sheet having a tab position that is to be the next tab position with reference to the major division tab sheet immediately prior to the change to be inserted as a minor division tab sheet.

5. The image forming apparatus as claimed in claim 1, wherein said first level of classification is a chapter, and said second level of classification is a section.

6. A method executed on an image forming apparatus comprising:

supplying tab sheets of an identical type from an identical sheet supply tray as a major division tab sheet to be inserted at a breakpoint of a first level of classification of a document to be printed, as well as a minor division tab sheet to be inserted at a breakpoint of a second level that is a finer level of classification than the first level of classification;

controlling to cause the tab sheet contained in said sheet supply tray to be discharged as an unnecessary tab sheet, if the tab position of the tab sheet to be supplied next from the sheet supply tray does not match with the tab position of the tab sheet to be inserted next during the printing of said document, until both of the tab positions match;

acquiring a first tab position range indicating a range of tab positions of tab sheets to be used as said major division tab sheets from a set of tab sheets and a second tab position range indicating a range of tab positions of tab sheets to be used as said minor division tab sheets from a set of tab sheets, the second tab position range being different from the first tab position range; and causing to vary sequentially within said first tab position range the tab position of a tab sheet to be inserted next if it is to be used as a major division tab sheet, and causing to vary sequentially within said second tab position range the tab position of a tab sheet to be inserted next if it is to be used as a minor division tab sheet.

7. A computer readable recording medium stored with a control program for controlling an image forming apparatus, said control program causing the image forming apparatus to execute a process comprising:

controlling to supply tab sheets of an identical type from an identical sheet supply tray as a major division tab sheet to be inserted at a breakpoint of a first level of classification of a document to be printed, as well as a minor division tab sheet to be inserted at a breakpoint of a second level that is a finer level of classification than the first level of classification;

controlling to cause the tab sheet contained in said sheet supply tray to be discharged as an unnecessary tab sheet, if the tab position of the tab sheet to be supplied next from the sheet supply tray does not match with the tab position of the tab sheet to be inserted next during the printing of said document, until both of the tab positions match;

acquiring a first tab position range indicating a range of tab positions of tab sheets to be used as said major division tab sheets from a set of tab sheets and a second tab position range indicating a range of tab positions of tab sheets to be used as said minor division tab sheets from a set of tab sheets, the second tab position range being different from the first tab position range; and causing to vary sequentially within said first tab position range the tab position of a tab sheet to be inserted next if it is to be used as a major division tab sheet, and causing to vary sequentially within said second tab position range said tab position of a tab sheet to be inserted next if it is to be used as a minor division tab sheet.

* * * * *